US009796195B2

(12) United States Patent
Lane

(10) Patent No.: US 9,796,195 B2
(45) Date of Patent: Oct. 24, 2017

(54) COMPACT WEB TENSION CONTROL ASSEMBLY FOR CONTROLLING THE TENSION OF MULTIPLE WEBS SIMULTANEOUSLY AND INDEPENDENTLY OF ONE ANOTHER IN A TANDEM MODE OF A WEB PRINTING SYSTEM

(71) Applicant: Océ-Technologies B.V., Venlo (NL)

(72) Inventor: John A. Lane, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/290,756

(22) Filed: Oct. 11, 2016

(65) Prior Publication Data

US 2017/0113474 A1 Apr. 27, 2017

(30) Foreign Application Priority Data

Oct. 22, 2015 (EP) ..... 15191082

(51) Int. Cl.

| | |
|---|---|
| ***B41J 15/16*** | (2006.01) |
| ***B65H 23/28*** | (2006.01) |
| ***B65H 23/04*** | (2006.01) |
| ***B65H 23/16*** | (2006.01) |
| ***B65H 18/10*** | (2006.01) |

(52) U.S. Cl.

CPC ..... *B41J 15/16* (2013.01); *B65H 18/103* (2013.01); *B65H 18/106* (2013.01); *B65H 23/048* (2013.01); *B65H 23/16* (2013.01); *B65H 23/28* (2013.01); *B65H 2301/23* (2013.01);

(Continued)

(58) Field of Classification Search

CPC ..... B41J 15/16; B65H 23/28; B65H 23/048; B65H 23/16; B65H 18/106; B65H 18/103; B65H 2801/06; B65H 2301/23; B65H 2404/152; B65H 2408/217

See application file for complete search history.

(56) References Cited

U.S. PATENT DOCUMENTS 5,348,278 A * 9/1994 Ring ..... B65H 23/035 270/52.01
5,558,263 A * 9/1996 Long ..... B65H 23/035 226/114
5,825,374 A * 10/1998 Albertalli ..... B41J 11/0085 226/156

FOREIGN PATENT DOCUMENTS

EP 2 053 003 A2 4/2009
GB 851139 10/1960

* cited by examiner

*Primary Examiner* — Bradley Thies
(74) *Attorney, Agent, or Firm* — Birch, Stewart, Kolasch & Birch, LLP

(57) ABSTRACT

A web processing apparatus comprising a web transport station and a web processing station. The web transport station comprises a web tension control assembly, which comprises a first tensioning device and a second tensioning device. Said first tensioning device is movably arranged for controlling tension of a first web. Said second tensioning device is movably arranged for controlling tension of a second web independently of the tension of the first web. Said first tensioning device comprises a first interior space and the first tensioning device is arranged with respect to the second tensioning device such that the first interior space at least partly accommodates the second tensioning device. The web processing apparatus allows for accurately controlling tension of the first and second webs simultaneously and independently of one another in a tandem mode, while maintaining the possibility for controlling tension of a single web in a single mode.

20 Claims, 6 Drawing Sheets

(52) U.S. Cl.
CPC .. *B65H 2404/152* (2013.01); *B65H 2408/217* (2013.01); *B65H 2801/06* (2013.01)

COMPACT WEB TENSION CONTROL ASSEMBLY FOR CONTROLLING THE TENSION OF MULTIPLE WEBS SIMULTANEOUSLY AND INDEPENDENTLY OF ONE ANOTHER IN A TANDEM MODE OF A WEB PRINTING SYSTEM

FIELD OF THE INVENTION

The present invention relates to a web processing apparatus comprising a web tension control assembly.

BACKGROUND ART

A known wide format inkjet printing apparatus comprises a web supply unit for supplying a web from a roll in a process direction towards a printing station and a web tension control assembly for controlling tension of the web at the print station in the process direction. The print station comprises an inkjet print head assembly for applying droplets of ink on the web.

In case of processing a single web in a single mode, the single web is supplied by the web supply unit to the printing station and droplets of ink on the web are applied on the single web by the printing station. The web tension control assembly comprises an elongated member for guiding the single web, the elongated member extending in a direction being substantially perpendicular to the process direction. The web tension control assembly further comprises a first arm and a second arm for mounting said elongated member to a frame at a pivoting axis for pivoting the elongated member, and a tension mechanism arranged for applying a force on the elongated member to control the tension on the web in the process direction.

In case of processing two webs simultaneously, in this application also referred to as tandem mode, by the wide format inkjet printing apparatus, a first web and a second web are transported alongside one another towards the printing station. The first web and the second web typically have a total width in the transverse direction, which does not exceed the width of the printing station and does not exceed the width of the web tension control assembly. The first web and second web are tensioned in the process direction by the elongated member of the web tension control assembly.

A disadvantage of said web tension control assembly is that the first web and second web are tensioned dependently one another in the tandem mode.

Furthermore there is a desire for a compact structure of the web tension control assembly suitable for controlling tension of a single web in a single mode and for controlling tension of a first web and a second web independently one another in a tandem mode.

SUMMARY OF THE INVENTION

It is accordingly an object of the present invention to provide a web processing apparatus comprising a web tension control assembly having a compact structure suitable for accurately controlling tension of a first web and controlling tension of a second web simultaneously and independently of one another in a tandem mode, while maintaining the possibility for controlling tension of a single web in a single mode.

In the present invention a web processing apparatus is provided, comprising a web transport station and a web processing station, said web transport station being arranged to transport, in a single mode of the web processing apparatus, a first web in a process direction towards or away from the web processing station, and to transport, in a tandem mode of the web processing apparatus, the first web and a second web in the process direction towards or away from the web processing station, the first web and second web being transported alongside one another in the tandem mode;

wherein the web transport station comprises a web tension control assembly comprising a first tensioning device and a second tensioning device, said first tensioning device being movably arranged for controlling tension of the first web, said second tensioning device being movably arranged for controlling tension of the second web independently of the tension of the first web, said first tensioning device comprising a first interior space, and wherein the first tensioning device is arranged with respect to the second tensioning device such that the first interior space at least partly accommodates the second tensioning device.

The web tension control assembly supports an accurate control of the tension of the first web and the second web independently one another in the process direction.

The web transport station may comprise a transport nip arranged for transporting the webs in the process direction. Alternatively or additionally the web transport station may comprise at least one roll handling device, each roll handling device arranged for driving a web from a roll in the process direction in an unwinding or winding movement of the roll.

The first tensioning device is arranged for controlling tension of the first web independently of the second tensioning device controlling tension of the second web. The first tensioning device comprises a first interior space, for example the first tensioning device encloses the first interior space. As the first interior space is arranged to at least partly accommodate the second tensioning device, the first tensioning device and the second tensioning device do not block one another in operation, and together provide a compact structure. As a result, the second tensioning device may control tension of the second web independently the tension of the first web, such as in a tandem mode, while the web control assembly has a compact structure as it substantially employs the same space as the first tensioning device. Furthermore, the single web in the single mode may be processed by the first tensioning device, wherein the single web may extend over a width of the web tension control assembly.

The first and second tensioning devices may be arranged for processing the first web and the second web alongside one another, parallel to one another, or in any other suitable position with respect to one another.

The web tension control assembly may be used for processing the first web and the second web simultaneously and may be used for processing the first web and the second web subsequently one another.

In an embodiment, the first tensioning device comprises a first elongated member for guiding the first web; a first arm and a second arm arranged for mounting the first elongated member to a frame; and a first pivoting axis; wherein the first elongated member is operatively connected to the first pivoting axis via the first arm and the second arm, which arms are operatively connected to opposite ends of the first elongated member, thereby forming the first interior space.

The first tensioning device provides a simple structure and a reliable control on the tension of the first web while providing a first interior space for accommodating the second tensioning device. The first arm and second arm in conjunction with the first elongated member and the first pivoting axis enclose the first interior space. The first arm and second arm including the first elongated member are pivotably arranged with respect to the first pivoting axis thereby defining a first operational path to tension the first web. In at least one pivot position of the first arm and second arm with respect to the first pivoting axis, the second tensioning device is disposed in between the first arm and second arm. The first interior space may suitably be selected by a skilled person in the art by adapting the position and length of the first arm, the second arm and the first elongated member.

In an embodiment, the second tensioning device comprises a second elongated member for guiding the second web; a third arm and a fourth arm arranged for mounting the second elongated member to the frame; and a second pivoting axis; wherein the second elongated member is operatively connected to the second pivoting axis via the third arm and the fourth arm, which arms are operatively connected to opposite ends of the second elongated member.

The second tensioning device provides a simple structure and a reliable control on the tension of the second web. The third arm and fourth arm including the second elongated member are pivotably arranged with respect to the second pivoting axis to move along a second operational path. The operational path needed for tensioning the second web may suitably be selected by a skilled person in the art by adapting the position and length of the third arm, the fourth arm and the second elongated member. The second tensioning device is arranged with respect to the first tensioning device such that the second operational path and the first operational path do not obstruct one another and the second operational path is arranged between the first arm and second arm of the first tensioning device along a direction parallel to the first elongated member.

Furthermore, in operation of the web tension control assembly, the second web may be arranged with respect to the second tensioning device such that the second web is center aligned with respect to the second tensioning device. This center alignment of the second web enhances control and balancing of the tension across the width of the web.

In an embodiment, the first elongated member has a first length $L_1$ and the second elongated member has a second length $L_2$, wherein $L_2$ is smaller than $L_1$.

The second elongated member is shorter than the first elongated member. The advantage is that the second elongated member may be arranged parallel to the first elongated member inside the first interior space of the first tensioning device.

The first web, which is guided by the first elongated member, may be selected having a larger width than the second web, which is guided by the second elongated member. For example, in case of processing a single web a single mode, the first tensioning device may control the tension of the first web, which has a larger width than the second web. The second tensioning device may be used to control a tension of the second web independently of the first tensioning device in a tandem mode or in another single mode. Herein a tandem mode is defined as tensioning a first web and a second web alongside one another.

Alternatively, in operation of the web tension control assembly, the first web may be suitably selected having a width being equal to or smaller than the width of the second web.

In an embodiment, both arms of the first tensioning device have a first arm length $M_1$ and both arms of the second tensioning device have a second arm length $M_2$, wherein $M_2$ is smaller than $M_1$.

The arms of the first tensioning device are longer than the arms of the second tensioning device. The arms of the first tensioning device are substantially equal to one another, being $M_1$. The arms of the second tensioning device are substantially equal to one another, being $M_2$. In this way, the arms of the second tensioning device can be arranged in between the arms of the first tensioning device and can be fully accommodated inside the first interior space.

In an embodiment, the second pivoting axis of the second tensioning device may substantially coincide with the first pivoting axis. In another embodiment, the second pivoting axis may be accommodated inside the first interior space. As a result, the second tensioning device is fully accommodated by the first interior space.

In an embodiment, the second tensioning device is arranged with respect to the first tensioning device for processing the first web and second web alongside one another in a tandem mode of the web tension control assembly.

The advantage is that the web tensioning device can be used for tensioning a single web in a single mode, i.e. the first web or the second web, and for tensioning two webs, i.e. the first web and second web, simultaneously and independently in a tandem mode.

In an embodiment, the second tensioning device is arranged eccentric with respect to the first tensioning device in a direction parallel to the first elongated member. Advantage is that the first web and the second web may be arranged extending over a width of the web tensioning device while preventing overlap of the first web and the second web in the plane of the respective webs. In such case, the first web is arranged eccentric relative to the first elongated member in the tandem mode.

In an example the first tensioning device may further comprise a restrictor element, such as a flange, which is movably arranged with respect to the first elongated member for guiding the first web, such as guiding the edge of the first web, in a width direction away from the second web tensioning device. Said restrictor element may for example be removed towards an axial end of the first elongated member in the single mode to allow the processing of a first web, which extends over the width of the first elongated member.

In an embodiment, the web tension control assembly further comprising a third tensioning device, said third tensioning device being movably arranged for controlling tension of a web independently of a tension of the second web;

wherein the first tensioning device is arranged with respect to the third tensioning device such that the first interior space at least partly accommodates the third tensioning device.

The arrangement of the third tensioning device provides a compact structure and a reliable control on the tension of the processed web independently of the tension of the second web. The first tensioning device does not block the third tensioning device tensioning the associated web as the third tensioning device is at least in part accommodated in the first interior space. The processed web in operation of the third tensioning device may be the first web and may be a third web. For example, the third tensioning device may be used to tension a third web independently of the tension of the second web and the tension of the first web.

The third tensioning device may be arranged alongside to the second tensioning device. Advantage is that the third tensioning device may be used together with the second tensioning device in a tandem mode of the web tension control assembly.

In an alternative embodiment, the second tensioning device forms a second interior space, i.e. the space enclosed by the second elongated member, the third arm, the fourth arm and the second elongated member, and the third tensioning device is arranged with respect to the second tensioning device such that the second interior space at least partly accommodates the third tensioning device. In this embodiment, the third tensioning device is arranged in between the third arm and the fourth arm in a direction parallel to the second elongated member.

In an embodiment, the third tensioning device is arranged alongside to the second tensioning device for processing the first web alongside the second web in a second tandem mode of the web tension control assembly.

In the second tandem mode the first web is processed by the third tensioning device.

In this embodiment, the web tension control assembly provides an accurate control of tension of the first web and second web independently one another. Another advantage is that the structure needed for the third tensioning device is at least partly disposed within the space needed to tension the first web in the single mode. This provides a compact mechanism for tensioning the respective webs.

Furthermore, in the second tandem mode the first web may be arranged such that the first web is center aligned with respect to the third web tensioning device. This center alignment of the first web enhances accurate control and balancing of the tension across the width of the first web.

In a particular embodiment, the arms of the first tensioning device are moveably arranged between an operational position with respect to the frame for processing the first web and a standby position with respect to the frame, wherein said first tensioning device does not obstruct the second tensioning device and third tensioning device.

In the standby position the first web is not processed by the first web tensioning device.

In an example, the arms may be movably arranged in a rotational direction about the first pivoting axis of the first tensioning device between the operational position and the standby position. As such, the first tensioning device including the first elongated element is pivoted about the first pivoting axis between the operational position and the standby position. In the standby position the first web tensioning device has a pivot position relative to the first pivoting axis, wherein the second tensioning device and the third tensioning device are not obstructed by the first tensioning device in the second tandem mode.

Alternatively, the arms may be movably arranged in a translational direction relative to the frame between the operational position and the standby position. For example, the arms of the first tensioning device may be movably mounted on the frame in a substantially linear direction between the operational position and the standby position. Said linear movement may be supported by a substantially linear slot mechanism arranged inside the frame. As such, the first pivoting axis including the arms is movable along said slot in the linear direction between the operational position and the standby position.

A person skilled in the art may contemplate, considering the structures and positions of the respective tensioning devices with respect to the frame, any other suitable direction of the arms to provide a standby position for not obstructing the other tensioning devices.

In an embodiment, the web tension control assembly further comprising a standby control mechanism adapted for retaining said first tensioning device in the standby position in the second tandem mode of the web tension control assembly.

The standby control mechanism may comprise a fastening device, such as a clamp, for fixing said first tensioning device in the standby position, may comprise a gate device, such as comprising a slot and a mechanical stop, may comprise a blocking device for keeping said first tensioning device away from the operational position and may comprise any other mechanism for retaining said web tensioning device in the standby position.

The standby control mechanism supports easy control of said web tensioning device in the standby position and enhances reliable use of the other tensioning devices.

In an embodiment, the first arm of the first tensioning device is operatively connected to the third arm of the second tensioning device via an angular position encoder for measuring a relative angular position of the first arm around the associated pivoting axis relative to the third arm by the angular position encoder.

The embodiment enables accurate measurement of the angular position of the arms of the first and second tensioning device respectively using one encoder only. In case the standby position of the arms of the unused tensioning device is known, such as in a fixed position, for the purposes of control, the relative angular position of the arms of the controlled tensioning device can be inferred to be an absolute angular position of said arms. The angular position encoder may, for example, be a rotary encoder, may be a translational encoder, and may be any other position encoder.

In an example, the first pivoting axis may be arranged concentric with respect to the second pivoting axis and the angular position encoder, for example a rotary encoder, may be arranged concentric to the first and second pivoting axis. The angular position encoder may be connected to the first arm of the first tensioning device via a shaft, while a housing of the rotary encoder is connected to the third arm of the second tensioning device. Said connections could also be reversed. As such said rotary encoder is able to measure the relative angular position of the first arm around the common pivoting axis relative to the third arm.

Alternatively, the first arm may be connected to the third arm via a gear train, which comprises a plurality of interlocking wheels, and the angular position encoder is connected to the gear train. The advantage of the gear train is that the first pivoting axis may be arranged eccentric with respect to the second pivoting axis, while measuring the relative angular position by the angular position encoder.

In an embodiment, the elongated member of at least one tensioning device comprises a torsion bar adapted for reducing a difference of tension across a width of the web extending along the torsion bar.

The torsion bar provides a torsional deformation to the elongated member during processing of the web for reducing a difference of tension across a width of the web. If a torsional load is applied by the web on the torsion bar, e.g. an axial torsional load, the torsion bar is arranged to deform to a certain extend.

The torsion bar may in examples be a hollow cylinder or a cross-shaped bar, wherein the material and dimensions of the torsion bar are suitably selected for providing a torsional deformation in operation of the web tensioning device.

In a particular embodiment, the torsion bar is non-rotatably connected to the arms and the arms are independently rotatable about the pivoting axis for supporting a torsional deformation of the torsion bar.

In an embodiment, the web transport station comprises a roll handling device for supporting at least one roll of web material, which roll handling device is arranged for driving the first web in the process direction in the single mode and driving the first web and the second web independently one another in the process direction in the tandem mode.

The roll handling device may be a web supply device arranged for unwinding the roll from a roll support and transporting the web towards the web processing station, and the roll handling device may be a web finishing device arranged for transporting the web from the web processing station and winding the web on a roll support to form a roll.

The roll handling device may comprise two roll supports and a drive assembly comprising a transmission mechanism for driving the first web on a first roll support, such as a spindle, and the second web on a second roll support independently one another in the process direction in the tandem mode. The transmission may be arranged for transmitting a torque from the drive assembly to both roll supports.

In embodiments, the transmission may be coupled to both web rolls for rotating both rolls of the first web and second web in parallel, and the transmission may comprise a differential transmission for equally distributing the torque amongst both rolls.

The roll handling device may comprise a spindle for supporting at least one roll of web material and may comprise two end supports for supporting the web roll at the ends thereof. For example the roll handling device may comprise a common spindle for supporting two web rolls. The common spindle may be driven to drive the first web and second web in parallel.

Alternatively the roll handling device may comprise two spindles for supporting two web rolls independently one another. The transmission mechanism may be arranged to equally distribute the torque amongst both spindles, thereby driving the first web and second web.

In an embodiment, the web processing station comprises a printing station arranged for applying a marking material on the first web in the single mode and arranged for applying the marking material on the first web and the second web in the tandem mode.

The printing station may be an inkjet printing station for applying droplets of ink on each web. The printing station preferably has a width in a transverse direction perpendicular to the process direction, which accommodates a total width of the first web and second web in the transverse direction in the tandem mode.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

Hereinafter, the present invention is further elucidated with reference to the appended drawings showing non-limiting embodiments and wherein.

DETAILED DESCRIPTION OF EMBODIMENTS

Figure 1:
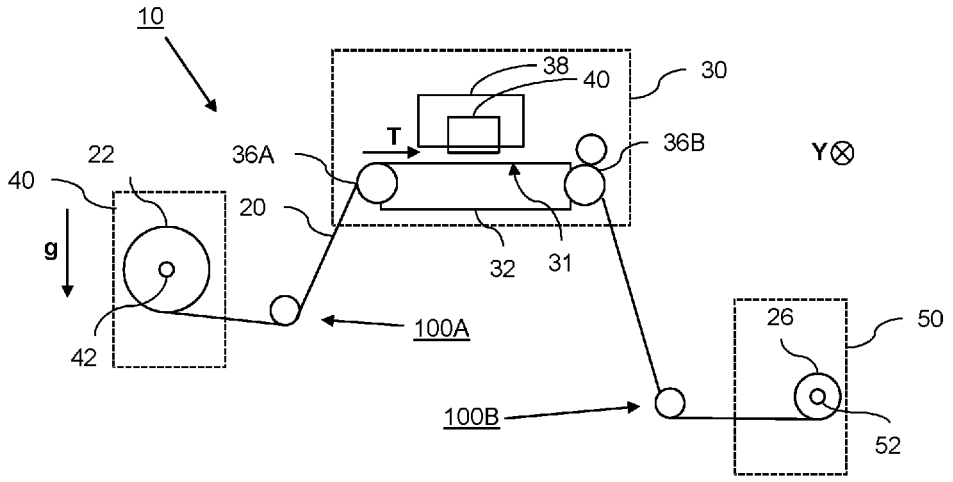
FIG. 1 shows a schematic view of a print engine in which web tension control assembly according to the invention may be used.

The present invention will now be described with reference to the accompanying drawings, wherein the same reference numerals have been used to identify the same or similar elements throughout the several views.

FIG. 1 shows a schematic side view of a print engine in which web tension control assembly according to the invention may be used.

FIG. 1 shows a roll-to-roll web printing device 10 for printing an image on a web 20. Such a printing device 10 is well known in the art. The printing device 10 comprises a printing station 30 comprising support assembly 32 on which a printing surface 31 is arranged. The printing surface 31 may be provided with suction holes for pulling the web 20 onto the printing surface 31 and thereby holding the web flat on the printing surface 31. The printing station further comprises a carriage 38 and at least one print head 40. The carriage 38 is movably supported such that the carriage 38 may be moved over the printing surface 31 in a direction normal to the plane of viewing as indicated by arrow Y. The carriage 38 supports said at least one print head 40 arranged for applying a marking material, such as an inkjet ink, on the web 20.

The printing device 10 further comprises a roll input device 40, a roll output device 50 and two web tensioning assemblies 100A and 100B.

A roll 22 of web medium 20 is supported and driven by a roll unwinding device 42, such as a spindle driven by a motor means arranged at one side of the spindle in the transverse direction Y, to supply the web 20 in a forward direction T towards a first web tensioning assemblies 100A. The web tensioning assemblies 100A to control tension of the web 20 in the forward direction T and guide the web 20 towards a guide element 36A to be positioned on the printing surface 31 of the printing station 30.

The web 20 is further transported, for example by transport nip 36B, in the forward direction T towards a second web tensioning assemblies 100B. The second web tensioning assemblies 100B to control tension of the web 20 in the forward direction T between the transport nip 36B and a roll winding device 50.

The web 20 is wound on a roll 26 in the roll output device 50 by a roll winding device 52, such as a spindle driven by a motor means arranged at one side of the spindle in the transverse direction Y.

In an alternative printing device, the transport nip 36B arranged to transport the web 20 over the printing surface 31 is positioned upstream of the printing surface 31 between the first web tensioning assemblies 100A and the printing surface 31 and the guiding element 36A is arranged downstream of the printing surface 31 between the printing surface 31 and the second web tensioning assemblies 100B.

FIGS. 2A-2G show an embodiment of the web tension control assembly according to the invention.

Figure 2A:
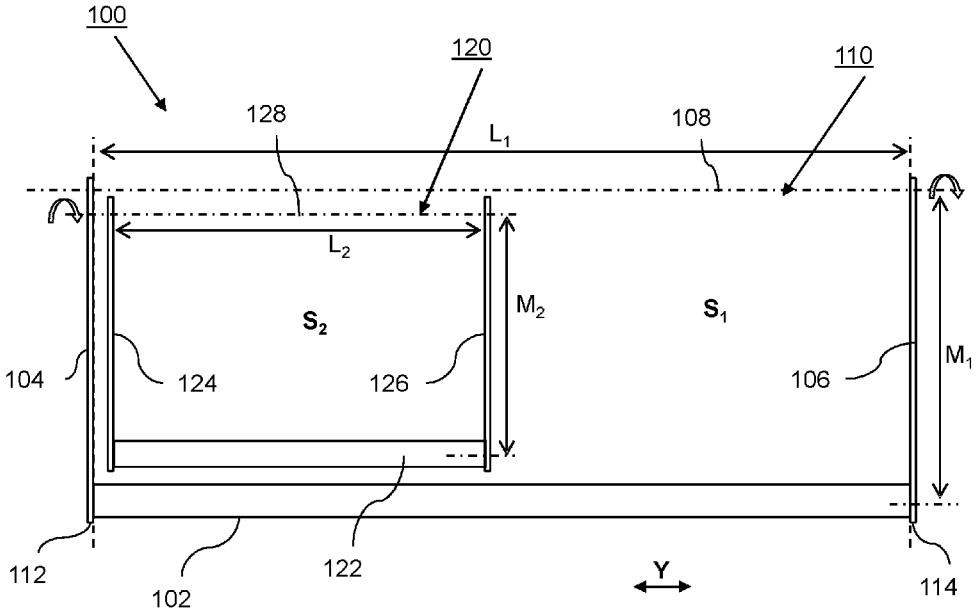
FIGS. 2A-2G show an embodiment of the web tension control assembly according to the invention.
Figure 2B:
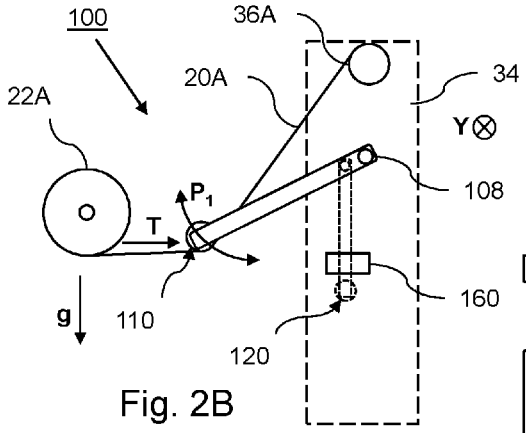
Figure 2C:
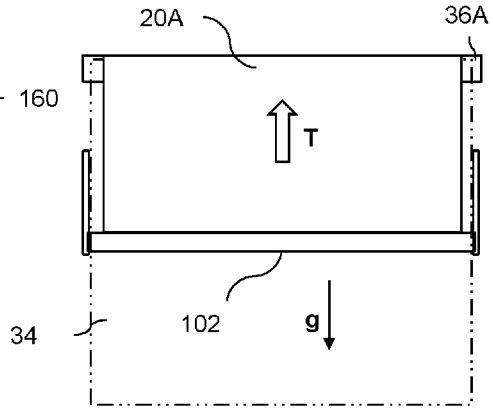
Figure 2D:
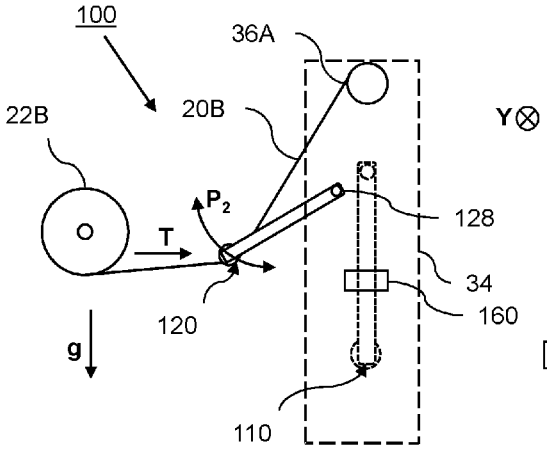
Figure 2E:
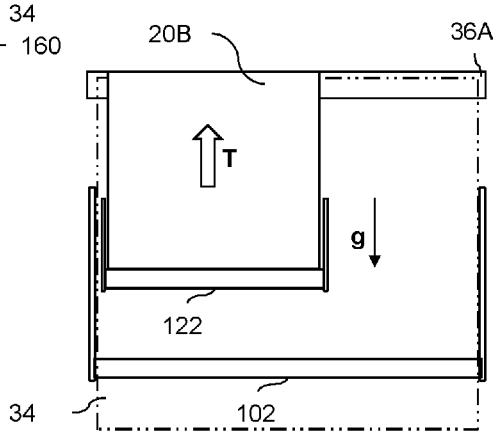
Figure 2F:
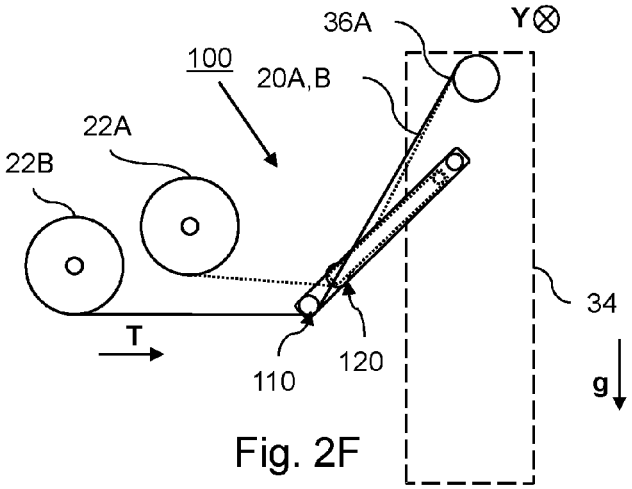

FIG. 2A shows a plane view of the web tension control assembly 100 comprising a first tensioning device 110 and a second tensioning device 120 arranged in relative position of one another as shown in side view FIG. 2F.

The first tensioning device 110 comprises a first elongated member 102 for guiding a web, a first arm 104 and a second arm 106 and a first pivoting axis 108. Both arms 104, 106 are arranged for mounting the first elongated member 102 to a frame at the first pivoting axis 108. In this way, the first elongated member 102 is pivotably arranged about the first pivoting axis 108.

The first elongated member 102 is operatively connected to the first pivoting axis 108 via the first arm 104 and the second 106. The arms 104, 106 are connected to opposite ends of the first elongated member 102. As such, a first interior space $S_1$ extends between the first elongated member 102, the arms 104, 106 and the first pivoting axis 108.

The second tensioning device 120 comprises a second elongated member 122 for guiding a web, a third arm 124 and a fourth arm 126 and a second pivoting axis 128. Both arms 124, 126 are arranged for mounting the second elongated member 122 to a frame at the second pivoting axis 128.

The second elongated member 122 is operatively connected to the second pivoting axis 128 via the third arm 124 and the fourth 126. The arms 124, 126 are connected to opposite ends of the second elongated member 122. As such, a second interior space $S_2$ extends between the second elongated member 122, the arms 124, 126 and the second pivoting axis 128.

In the position shown in FIGS. 2A and 2F the first tensioning device 110 and the second tensioning device 120 are arranged to one another such that second tensioning device 120 is accommodated inside the first interior space $S_1$ of the first tensioning device 110.

The first elongated member 102 has a first length L1 and the second elongated member 122 has a second length L2 in a direction as indicated by arrow Y. The first elongated member 102 and the second elongated member 122 are arranged parallel of one another along a transverse direction Y. The second length L2 is smaller than the first length L1. As such, the second elongated member 122 can be arranged in between the arms 104, 106 of the first tensioning device 110 and can be accommodated inside the first interior space $S_1$.

Both arms 104, 106 of the first tensioning device 110 have a first arm length M1. Both arms 124, 126 of the second tensioning device 120 have a second arm length M2. The second arm length M2 is smaller than the first arm length M1. As such, the arms 124, 126 of the second tensioning device 120 can be arranged in between the arms 104, 106 of the first tensioning device 110 and can be fully accommodated inside the first interior space $S_1$, as shown in FIG. 2A.

The first pivoting axis 108 and the second pivoting axis 128 are arranged parallel of one another. In fact, in the embodiment shown in FIG. 2A, the second pivoting axis 128 is arranged offset from the first pivoting axis 108 to be accommodated inside the first interior space $S_1$. In an alternative embodiment, the first pivoting axis 108 and the second pivoting axis 128 are arranged concentric of one another.

FIGS. 2B and 2C show a single mode of the web tension control assembly 100, wherein a first web is processed by the first tensioning device 110. FIG. 2B is a side view of the web tension control assembly 100 and FIG. 2C is a front view of the web tension control assembly 100 along a transverse direction Y and the gravity direction of gravity as indicated by arrow g.

The first web is supplied from a roll 22A and is transported in a forward direction T along the web tension control assembly 100 towards the guide element 36A.

In the single mode the first tensioning device 110 is arranged in an operational position with respect to the frame 34, such as a position as shown in FIG. 2B, to process the first web 20*a*. In the embodiment shown the first tensioning device 110 is movably arranged about the first pivoting axis 108 along a first operational path as indicated by arrow $P_1$ to process the first web 20*a*.

The tension of the first web 20*a* may be controlled by way of a gravitational force of the first tensioning device 110 acting on the first web 20A. Alternatively, the tension of the first web 20*a* may be controlled by a spring force or any other suitable force acting on the first elongated member 102.

In the single mode the second tensioning device 120 is arranged in a standby position with respect to the frame 34, such as a vertical position in a direction parallel to the gravity as indicated by arrow g shown in FIG. 2B. In this way, the second tensioning device 120 does not obstruct the first tensioning device 110 to be moved along the first operational path as indicated by arrow $P_1$ and does not obstruct the first web 20*a* to be processed by the first tensioning device 110.

The web tension control assembly 100 may optionally comprise a fastening device 160, such as a clamp mounted on the frame 34, for fixing said second tensioning device 120 in the standby position.

FIGS. 2D and 2E show an alternative single mode of the web tension control assembly 100, wherein a second web 20*b* is processed by the second tensioning device 120. FIG. 2D is a side view of the web tension control assembly 100 and FIG. 2E is a front view of the web tension control assembly 100 along a transverse direction Y and the gravity direction of gravity as indicated by arrow g.

The second web 20*b* is supplied from a roll 22*b* and is transported in a forward direction T along the web tension control assembly 100 towards the guide element 36A.

In the alternative single mode the second tensioning device 120 is arranged in an operational position with respect to the frame 34, such as a position as shown in FIG. 2D, to process the second web 20*b*. In the embodiment shown the second tensioning device 120 is movably arranged about the second pivoting axis 128 along a second operational path as indicated by arrow $P_2$ to process the second web 20*b*.

In the alternative single mode the first tensioning device 110 is arranged in a standby position with respect to the frame 34, such as a vertical position in the direction parallel to the gravity as indicated by arrow g shown in FIG. 2D. In this way, the first tensioning device 110 does not obstruct the second tensioning device 120 to be moved along the second operational path as indicated by arrow $P_2$ and does not obstruct the second web 20*b* to be processed by the second tensioning device 120.

The web tension control assembly 100 may optionally comprise a fastening device 160, such as a clamp mounted on the frame 34, for fixing said first tensioning device 110 in the standby position.

The first web 20*a* processed in the first single mode shown in FIGS. 2B-2C extends along the first elongated member 102. The second web 20*b* processed in the second single mode shown in FIGS. 2D-2E extends along the second elongated member 122. The first web 20*a* may have a larger width in the transverse direction Y with respect to a width of the second web 20*b* in the transverse direction Y, as the first length $L_1$ is larger than the second length $L_2$.

Figure 2G:
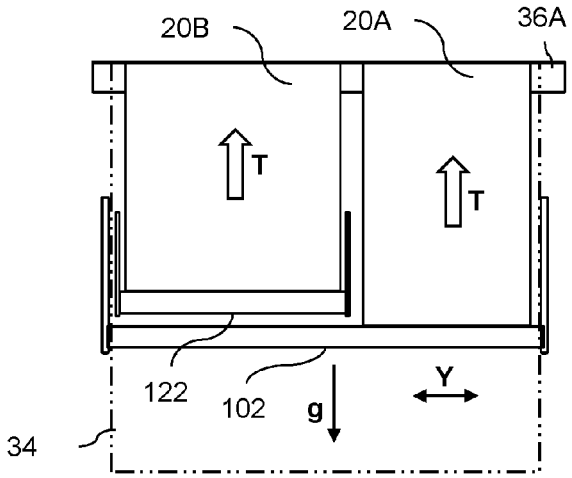

FIGS. 2F and 2G show a tandem mode of the web tension control assembly 100, wherein a first web 20*a* is processed by the first tensioning device 110 and a second web 20*b* is processed by the second tensioning device 120 simultaneously. FIG. 2F is a side view of the web tension control assembly 100 and FIG. 2G is a front view of the web tension control assembly 100 along a transverse direction Y and the gravity direction of gravity as indicated by arrow g.

The first web 20*a* and the second web 20*b* are supplied from a respective roll 22*a*, 22*b* and are transported in a forward direction T along the web tension control assembly 100 towards the guide element 36A. The first web 20*a* and the second web 20*b* are arranged alongside one another in the transverse direction Y as is shown in FIG. 2G.

The roll 22*a* and roll 22*b* may be arranged alongside one another in the transverse direction Y, e.g. mounted on a single roll handling device, to supply the first web 20*a* and the second web 20*b* alongside one another.

In the tandem mode the first tensioning device 110 is arranged in an operational position with respect to the frame 34, such as a position as shown in FIG. 2F, to process the first web 20*a*. In the embodiment shown the first tensioning device 110 is movably arranged about the first pivoting axis 108 along a first operational path as indicated by arrow $P_1$ to process the first web 20*a*.

At the same time, the second tensioning device 120 is arranged in an operational position with respect to the frame 34, such as a position as shown in FIG. 2F, to process the second web 20*b*. In the embodiment shown the second tensioning device 120 is movably arranged about the second pivoting axis 128 along a second operational path as indicated by arrow $P_2$ to process the second web 20*b*.

The first tensioning device 110 and the second tensioning device 120 do not block one another while tensioning the first web 20*a* and the second web 20*b* respectively.

In fact, the first tensioning device 110 and the second tensioning device 120 control the tension of the first web 20*a* and the second web 20*b* independently of one another.

Figure 3A:
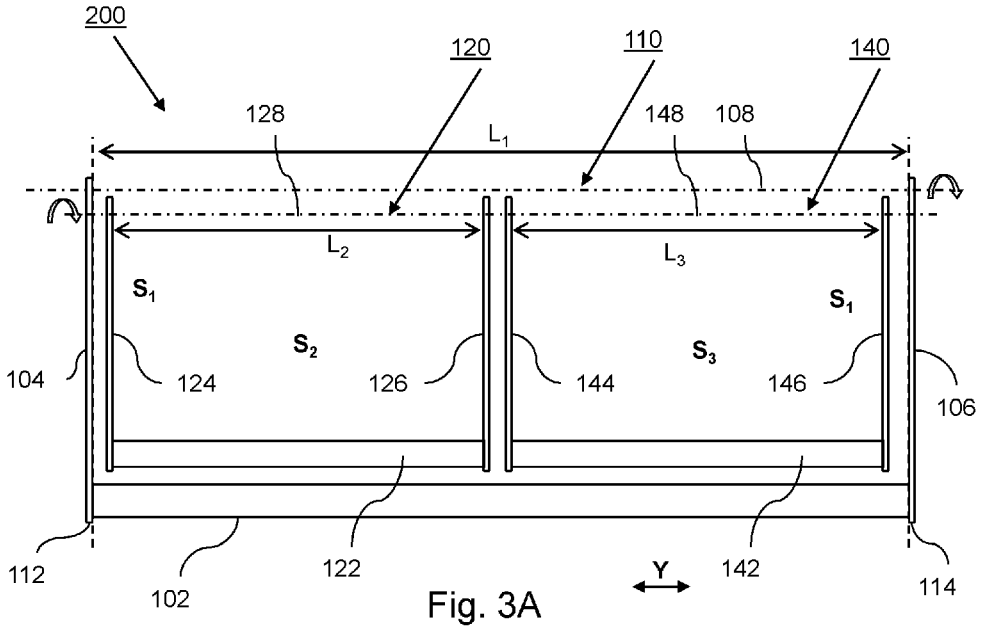
FIGS. 3A-3C show another embodiment of the web tension control assembly according to the invention.
Figure 3B:
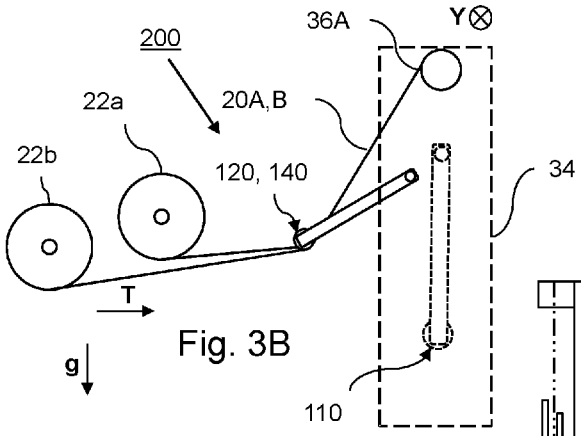
Figure 3C:
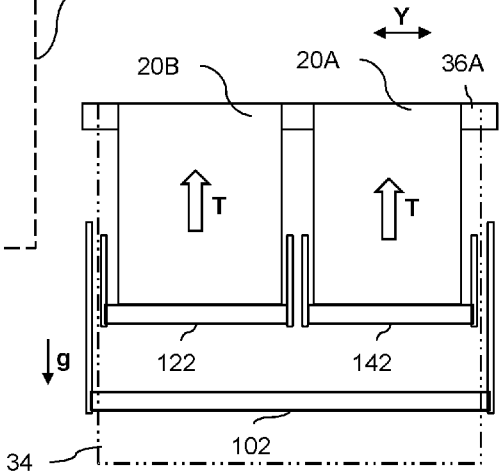

FIGS. 3A-3C show another embodiment of the web tension control assembly according to the invention.

FIG. 3A shows a plane view of the web tension control assembly 200 comprising a first tensioning device 110, a second tensioning device 120 and a third tensioning device 140.

The first tensioning device 110 and the second tensioning device 120 have the same structure as described in relation to the embodiment shown in FIGS. 2A-2G.

Additionally the web tension control assembly 200 comprises the third tensioning device 140 for tensioning a web.

The third tensioning device 140 comprises a third elongated member 142 for guiding the web, a fifth arm 144 and a sixth arm 146 and a third pivoting axis 148. Both arms 144, 146 are arranged for mounting the third elongated member 142 to a frame at the third pivoting axis 148.

The third elongated member 142 is operatively connected to the third pivoting axis 148 via the fifth arm 144 and the sixth 146. The arms 144, 146 are connected to opposite ends of the third elongated member 142. As such, a third interior space $S_3$ extends between the third elongated member 142, the arms 144, 146 and the third pivoting axis 148.

The second tensioning device 120 and the third tensioning device 140 are arranged alongside one another in the transverse direction Y.

In the position shown in FIG. 3A the first tensioning device 110, the second tensioning device 120 and the third tensioning device 140 are arranged to one another, i.e. in a pivoting position with respect to the respective pivoting axis 108, 128, 148, such that second tensioning device 120 and the third tensioning device 140 are accommodated inside the first interior space S1 of the first tensioning device 110.

The first elongated member 102 has a first length L1, the second elongated member 122 has a second length L2 and the third elongated member 142 has a third length L3 in a transverse direction as indicated by arrow Y. The first elongated member 102, the second elongated member 122 and the third elongated member 142 are arranged parallel of one another along the transverse direction Y. The second length L2 and the third length L3 are smaller than the first length L1. The sum of the second length L2 and the third length L3 is smaller than the first length L1 (i.e. L2+L3<L1). As such, the second elongated member 122 and the third elongated member 142 can be arranged alongside one another in between the arms 104, 106 of the first tensioning device 110 and can be accommodated inside the first interior space $S_1$.

FIGS. 3B and 3C show a tandem mode of the web tension control assembly 200, wherein a first web 20*a* is processed by the third tensioning device 140 and a second web 20*b* is processed by the second tensioning device 120 simultaneously. FIG. 3B is a side view of the web tension control assembly 200 and FIG. 3C is a front view of the web tension control assembly 200 along a transverse direction Y and the gravity direction of gravity as indicated by arrow g.

The first web 20*a* and the second web 20*b* are supplied from a respective roll 22*a*, 22*b* and are transported in a forward direction T along the web tension control assembly 200 towards the guide element 36A. The first web 20*a* and the second web 20*b* are arranged alongside one another in the transverse direction Y as is shown in FIG. 3C.

In the tandem mode the third tensioning device 140 is arranged in an operational position with respect to the frame 34, such as a position as shown in FIG. 3B, to process the first web 20*a*. In the embodiment shown the third tensioning device 140 is movably arranged about the first pivoting axis 148 along a third operational path as indicated by arrow $P_3$ to process the first web 20*a*.

At the same time, the second tensioning device 120 is arranged in an operational position with respect to the frame 34, such as a position as shown in FIG. 3B, to process the second web 20*b*. In the embodiment shown the second tensioning device 120 is movably arranged about the second pivoting axis along a second operational path as indicated by arrow $P_2$ to process the second web 20*b*.

The third tensioning device 140 and the second tensioning device 120 do not block one another while tensioning the first web 20*a* and the second web 20*b* respectively.

In fact, the third tensioning device 140 and the second tensioning device 120 control the tension of the first web 20*a* and the second web 20*b* independently of one another.

In the tandem mode the first tensioning device 110 is arranged in a standby position with respect to the frame 34, such as a vertical position in the direction parallel to the gravity as indicated by arrow g shown in FIG. 3B. In this position the first tensioning device 110 does not obstruct the second tensioning device 120 and the third tensioning device 140 to be moved along the second operational path and third operational path as indicated by arrow $P_2$ and $P_3$, and does not obstruct the first web 20*a* and the second web 20*b* to be processed by the third tensioning device 140 and the second tensioning device 120 respectively.

In a single mode the web tension control assembly 200 may be operated to process a first web 20*a* by the first tensioning device 110 in an operational position of the first tensioning device 110, while the third tensioning device 140 and the second tensioning device 120 are arranged in a standby position. The operational position of the first tensioning device 110 and the standby position of the third tensioning device 140 and the second tensioning device 120 may be similar to the operational position and standby position shown in FIG. 2C of the first tensioning device 110 and the second tensioning device 120 respectively.

In a second single mode a second web 20*b* is processed by the second tensioning device 120, while the first tensioning device 110 and the third tensioning device 140 are arranged in a standby position for not obstructing the second tensioning device 120.

In a third single mode a third web is processed by the third tensioning device 140, while the first tensioning device 110 and the second tensioning device 120 are arranged in a standby position for not obstructing the third tensioning device 140.

Figure 4:
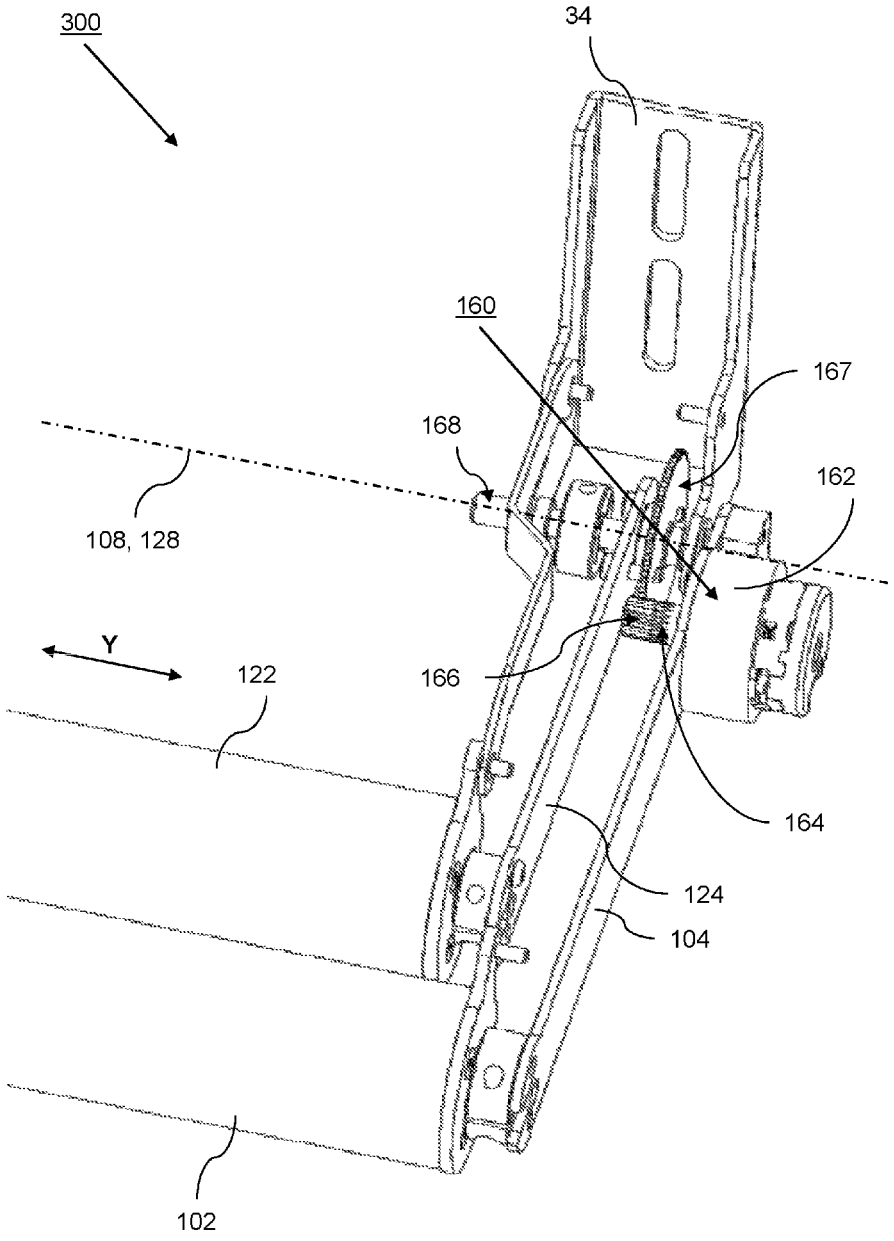
FIG. 4 shows a modified embodiment of the web tension control assembly shown in FIGS. 2A-2G or in FIGS. 3A-3C.

FIG. 4 shows a modified embodiment of the web tension control assembly shown in FIGS. 2A-2G or FIGS. 3A-3C.

FIG. 4 shows a perspective view of a detail of the web tension control assembly 300. The web tension control assembly 300 comprises the same components as the web tension control assembly 200 shown in FIG. 2A. However, in this embodiment the first pivoting axis 108 of the first tensioning device 110 is arranged concentric with respect to the second pivoting axis 128 of the second tensioning device 120.

Additionally the web tension control assembly 300 comprises a first rotary encoder 160. The first rotary encoder 160 comprises a housing part 162 and a shaft element 164 which is rotatably arranged with respect to the housing part 162 to determine an angular position. The housing part 162 is mounted on the first arm 104 of the first tensioning device 110. The shaft element 164 is operatively connected to the third arm 124 of the second tensioning device 120 via a gear wheel train comprising a first wheel 166 and a second wheel 167. The first wheel 166 and the second wheel 167 are mutually connected in an inter teeth arrangement. The first wheel 166 is mounted on the shaft 164 and the second wheel 167 is mounted on a shaft 168 which is connected to the third arm 124 concentric to the second pivoting axis 128.

In this way, the first rotary encoder 160 is able to determine a relative angular position of the first arm 104 about the pivoting axis 108 with respect to the third arm 124 about the pivoting axis 128.

The first rotary encoder 160 is coupled to a control unit arranged to receive a signal from the first rotary encoder 160 in response to the relative angular position measured. This embodiment enables accurate measurement of the angular position of the arms of the first tensioning device 110 and second tensioning device 120 respectively using a single encoder only. In case the standby position of the arms of the second tensioning device 120 is known, such as in a standby position of the second tensioning device 120 as shown in FIG. 2B, for the purposes of control, the relative angular position of the arms of the first tensioning device 110 can be inferred to be an absolute angular position of said arms of the first tensioning device 110. In this way, an angular position of the first tensioning device 110 along the operational path P1 is determined.

In the second single mode shown in FIGS. 2D-2E the same rotary encoder 160 may be employed to determine the absolute angular position of the arms of the second tensioning device 120 based on a known standby position of the first tensioning device 110. In this way, an angular position of the second tensioning device 120 along the operational path P2 is determined using the same rotary encoder 160.

Figure 5A:
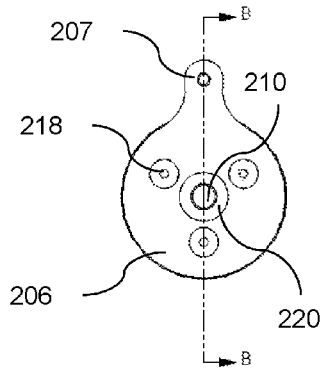
FIGS. 5A-5B show a detailed view of a modified elongation member of a web tension control assembly according to the invention.
Figure 5B:
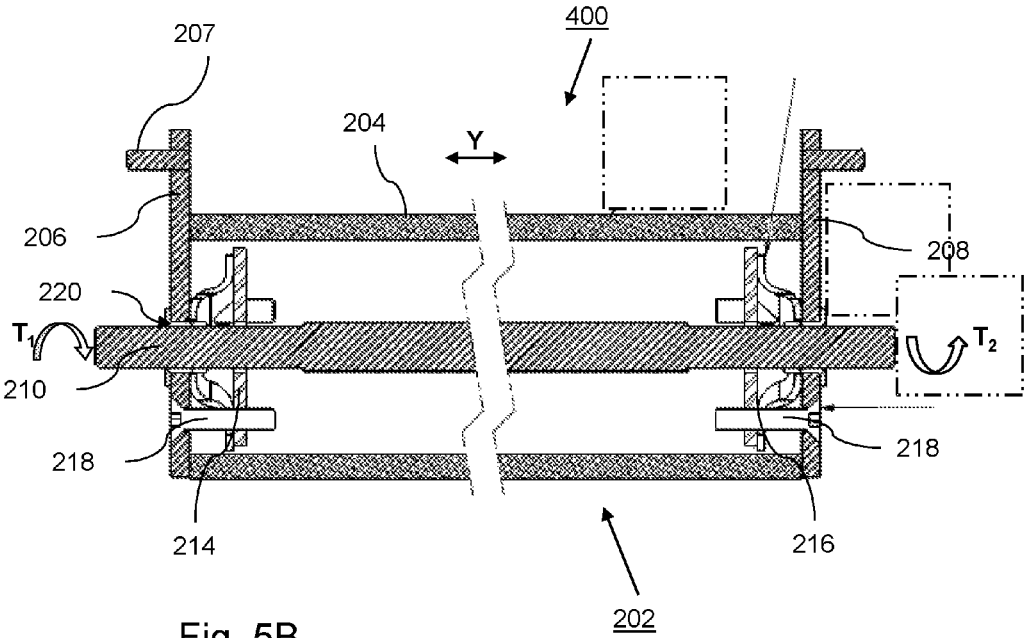

FIGS. 5A-5B show a detailed view of a modified elongated member of a web tension control assembly according to the invention. FIG. 5A is a side view of the modified elongation member. FIG. 5B is a cross-sectional view of the modified elongation member along a line B-B shown in FIG. 5A.

The elongated member 202 comprises a first flange 206, a second flange 208, a tube 204 and a torsion bar 210.

The first flange 206 is arranged at a first end of the tube 204. The second flange 208 is arranged at a second end of the tube 204 opposite to the first end of the tube 204 in the transverse direction Y. The tube 204 is mounted on the first flange 206 and the second flange 208 to guide a web along the elongated member 202. The tube 204 is fixed to each of the flanges 204, 206 by way of a first clamp 214 and a second clamp 216 respectively using fasteners 218.

The first flange 206 is connected to a draglink at a protruding portion 207 to maintain the tube 206 substantially stationary in a rotational direction about a main axis of the elongated member 202 such that a web has a sliding contact with respect to the tube 206 in operation of the elongated member 202.

The first flange 206 and the second flange 208 are mounted on the torsion bar 210 by way of bearings 220. The bearings provide a sliding contact between the flanges 206, 208 and the torsion bar 210. The torsion bar 210 is clamped to a first arm of the tensioning device at a first end of the torsion bar 210 and is clamped to a second arm of the tensioning device at a first end of the torsion bar 210 opposite to the first end in the transverse direction Y.

The torsion bar 210 is shaped, such that in operation of the tensioning device 400 the torsion bar may torsionally deform as indicated by arrows T1 and T2 in case a tension of the web is not balanced in a transverse direction Y. As a result, a spring restoring torque is created inside the torsion bar 210 in a direction opposite to the torsional deformation (i.e. opposite to the directions T1 and T2). Furthermore, the deformation of the torsion bar 210 temporarily reduces a difference of tension of the web present along a transverse direction Y.

In an example, the torsion bar 210 may be a cylinder having a diameter 12 mm that passes through the 50 mm diameter of the tube.

The application of the modified elongated member 202 having a torsion bar 210 enables a reduction of a difference of tension of the web present along a transverse direction Y. In order to effectively use the elongated member 202 to balance the web tension across the width of the web along the transverse direction Y, the web is preferably arranged substantially centric with respect to the elongated member 202 in between the first flange 206 and the second flange 208.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms “a” or “an”, as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A web processing apparatus, comprising a web transport station and a web processing station, said web transport station being arranged to transport, in a single mode of the web processing apparatus, a first web in a process direction towards or away from the web processing station, and to transport, in a tandem mode of the web processing apparatus, the first web and a second web in the process direction towards or away from the web processing station, the first web and second web being transported alongside one another in the tandem mode, wherein the web processing apparatus comprises a printing station comprising a printing surface for supporting the first web alongside the second web when viewed in a transverse direction perpendicular to the process direction of the first web and the second web when moving in tandem over the printing surface, and wherein the web transport station comprises a web tension control assembly comprising a first tensioning device and a second tensioning device, said first tensioning device being movably arranged for controlling tension of the first web, said second tensioning device being movably arranged for controlling tension of the second web independently of the tension of the first web, said first tensioning device comprising a first interior space, and wherein the first tensioning device is arranged with respect to the second tensioning device such that the first interior space at least partly accommodates the second tensioning device.

2. The web processing apparatus according to claim 1, wherein the first tensioning device comprises:

a first elongated member for guiding the first web;

a first arm and a second arm arranged for mounting the first elongated member to a frame;

a first pivoting axis;

wherein the first elongated member is operatively connected to the first pivoting axis via the first arm and the second arm, which arms are operatively connected to opposite ends of the first elongated member, thereby forming the first interior space.

3. The web processing apparatus according to claim 2, wherein the second tensioning device comprises:

a second elongated member for guiding the second web;

a third arm and a fourth arm arranged for mounting the second elongated member to the frame;

a second pivoting axis;

wherein the second elongated member is operatively connected to the second pivoting axis via the third arm and the fourth arm, which arms are operatively connected to opposite ends of the second elongated member.

4. The web processing apparatus according to claim 3, wherein the first elongated member has a first length $L_1$ and the second elongated member has a second length $L_2$, wherein $L_2$ is smaller than $L_1$.

5. The web processing apparatus according to claim 3, wherein both arms of the first tensioning device have a first arm length $M_1$ and both arms of the second tensioning device have a second arm length $M_2$, wherein $M_2$ is smaller than $M_1$.

6. The web processing apparatus according to claim 3, wherein the first arm of the first tensioning device is operatively connected to the third arm of the second tensioning device via an angular position encoder for measuring a relative angular position of the first arm around the associated pivoting axis relative to the third arm by the angular position encoder.

7. The web processing apparatus according to claim 3, wherein the elongated member of at least one tensioning device comprises a torsion bar adapted for reducing a difference of tension across a width of the web extending along the torsion bar.

8. The web processing apparatus according to claim 1, wherein the second tensioning device is arranged with respect to the first tensioning device for processing the first web and second web alongside one another in the tandem mode of the web tension control assembly.

9. The web processing apparatus according to claim 1, the web tension control assembly further comprising a third tensioning device, said third tensioning device being movably arranged for controlling tension of a web independently of a tension of the second web;

wherein the first tensioning device is arranged with respect to the third tensioning device such that the first interior space at least partly accommodates the third tensioning device.

10. The web processing apparatus according to claim 9, wherein the third tensioning device is arranged alongside to the second tensioning device for processing the first web alongside the second web in a second tandem mode of the web tension control assembly.

11. The web processing apparatus according to claim 9, wherein the arms of the first tensioning device are moveably arranged between an operational position with respect to the frame for processing the first web and a standby position with respect to the frame, wherein said first tensioning device does not obstruct the second tensioning device and third tensioning device.

12. The web processing apparatus according to claim 11, further comprising a standby control mechanism adapted for retaining said first tensioning device in the standby position in the second tandem mode of the web tension control assembly.

13. The web processing apparatus according to claim 1, wherein the web transport station comprises a roll handling device for supporting at least one roll of web material, which roll handling device is arranged for driving the first web in the process direction in the single mode and driving the first web and the second web independently one another in the process direction in the tandem mode.

14. The web processing apparatus according to claim 1, wherein the printing station is arranged for applying a marking material on the first web in the single mode and arranged for applying the marking material on the first web and the second web in the tandem mode.

15. The web processing apparatus according to claim 1, wherein the printing station further comprises a carriage and at least one print head, wherein the carriage is movable over the printing surface in the transverse direction, wherein the carriage supports said at least one print head arranged for applying a marking material on each of the first and the second web when supported on the printing surface.

16. The web processing apparatus according to claim 1, wherein the transverse direction is perpendicular to a direction of gravity.

17. The web processing apparatus according to claim 16, wherein the second pivoting axis of the second tensioning device substantially coincides with the first pivoting axis.

18. The web processing apparatus according to claim 16, wherein the second pivoting axis is accommodated inside the first interior space.

19. The web processing apparatus according to claim 16, wherein the second tensioning device is fully accommodated by the first interior space.

20. A tandem web printing system comprising the web processing apparatus according to claim 1.

* * * * *